United States Patent [19]

Honda et al.

[11] 3,942,558

[45] Mar. 9, 1976

[54] TORSIONAL REED REFERENCE FLUIDIC OSCILLATOR

[75] Inventors: Thomas Shaw Honda; Carl Gustave Ringwall, both of Scotia, N.Y.

[73] Assignee: General Electric Company, New York, N.Y.

[22] Filed: Oct. 10, 1974

[21] Appl. No.: 513,841

[52] U.S. Cl. ..... 137/826; 137/829; 137/833; 137/835; 137/814; 137/83; 137/624.14

[51] Int. Cl.[2] ..... F15C 3/14

[58] Field of Search ..... 137/826, 829, 830, 832, 137/835, 836, 83, 624.14

[56] References Cited

UNITED STATES PATENTS

| | | | |
|---|---|---|---|
| 3,333,596 | 8/1967 | Bottone, Jr. | 137/830 X |
| 3,399,688 | 9/1968 | Westerman, Jr. | 137/836 X |
| 3,534,755 | 10/1970 | Urbanosky | 137/833 X |
| 3,540,290 | 11/1970 | Shinn et al. | 137/829 X |
| 3,695,283 | 10/1972 | Ringwall | 137/829 |

*Primary Examiner*—William R. Cline
*Attorney, Agent, or Firm*—Stephen A. Young; Walter C. Bernkopf; Robert A. Cahill

[57] ABSTRACT

A torsional reed reference fluidic oscillator operating within 0.1% of the desired frequency over a temperature range of −65° to +165°F and an operating pressure of from 1 to 4 psi. The oscillator includes a torsional reed fluidic amplifier and fluidic feedback means for converting output signals from output ports of the amplifier to first and second input signals having a phase relationship for insuring operation of the apparatus as an oscillator. The amplifier is comprised of first, second and third plates, an elongated reed member, first and second torsional members and a tab, all of which are made of material having negligible thermal coefficient of expansion and negligible change in modulus of elasticity over the temperature range. The reed member is positioned within an elongated slot in the first plate, and is fixed thereto by the first and second torsional members, wherein the major axis of the torsional members is perpendicular to the plane and major axis of the reed member. The second and third plates each has a supply port, a channel fluidically coupled to the supply port, and an output port fluidically coupled to the channel. The tab, having a hole therethrough, extends from the reed member in a plane perpendicular to the major axis of the torsional members and the reed member. The tab is received within the channels in the second and third plates, and is movable between a first and second position upon corresponding movement of the reed member which is responding to the reception of the first and second fluidic input signals from the fluidic feedback means. The fluidic resonant frequency of the oscillator is approximately equal to a fixed mechanical resonant frequency of the reed member, whereby the oscillator oscillates at that mechanical resonant frequency.

31 Claims, 4 Drawing Figures

TORSIONAL REED REFERENCE FLUIDIC OSCILLATOR

The invention herein described was made in the course of or under a contract or subcontract thereunder, with the Department of the U.S. Army.

BACKGROUND OF THE INVENTION

1. Field of the Invention

This invention relates to a torsional reed reference fluidic oscillator, and also to an improved torsional reed fluidic amplifier.

2. Description of the Prior Art

In a torsional reed reference fluidic oscillator, the frequency of oscillation is determined by the mechanical resonant frequency of an oscillating reed member, wherein the reed member is a component of a torsional amplifier of the oscillator. However, this reed member is normally a thin elongated planar structure which tends to have a flapping motion when it oscillates about an axis determined by a pair of torsional members positioned perpendicular to the major axis of the reed member. Since the square of the mechanical resonant frequency of the reed member is generally equal to the torsional spring rate of the torsional members divided by the moments of inertia of the mass of the reed about its torsional axis, this formula relationship would be expected to accurately predict the operating frequency of the oscillator. However, the flapping motion of the reed member imposes thereon another mode of oscillation which causes a shift in the desired center frequency of the oscillator, thereby limiting the stability and predetermined accuracy of the oscillator.

Similarly, this torsional reed reference fluidic oscillator has a tab extending from one end of the reed member perpendicular to the plane of the reed member and parallel to the major axis of the torsional members. The tab normally has a hole therethrough, and is received within channels of two separate plates. When the hole in the tab is aligned with the channel in one of the plates, that plate provides an output signal for the amplifier, and when the hole in the tab is aligned with the other of the plates, that other plate provides another output signal for the amplifier. These output signals are, in turn, coupled to fluidic feedback means for converting the output signal to first and second input signals which are applied to the reed member at a proper phase relationship for insuring operation of the entire apparatus as an oscillator. However, since the plane of the tab is parallel to the torsional axis of the reed member, supply fluid coupled to the channels of the plates impinges on the tab and applies a torsional force to the reed member. This torsional force again causes a shifting in the resonant frequency of oscillation of the reed member as it oscillates about its torsional axis, and and limits the stability and predetermined accuracy of the fluidic oscillator.

Furthermore, this torsional reed reference oscillator should be operated at a high pressure to insure that it would always be self starting. However, a high operating pressure generally causes a decrease in the overall performance of the oscillator, and can severely limit its predetermined accuracy and frequency stability. Still further, since the mechanical characteristics of the components of the oscillator often change over the desired operating temperature and pressure ranges, the frequency stability of the oscillator over this broad range is difficult to maintain.

OBJECTS OF THE INVENTION

It is therefore an object of this invention to provide for an improved torsional reed reference fluidic oscillator having a stability of operation of within 0.1% of the desired frequency over a temperature range of −65° to +165°F and at an operating pressure of from 1 to 4 psi.

It is another object of this invention to provide an improved torsional reed reference fluidic oscillator which is mechanically stable over an operating temperature of from −65° to +165°F.

It is another object of this invention to provide for an improved torsional reed fluidic amplifier which has a reed member that is only responsive to fluidic input signals.

It is a further object of this invention to provide for an improved torsional reed fluidic amplifier having a reed member which does not flap in secondary modes when it moves.

Other objects of the invention will be pointed out hereinafter.

SUMMARY OF THE INVENTION

According to a broad aspect of this invention, there is provided a torsional reed reference fluidic oscillator that operates within 0.1% of the desired frequency over a temperature range of −65° to +165°F and an operating pressure of from 1 to 4 psi. The oscillator includes a torsional reed reference fluidic amplifier and fluidic feedback means for converting output signals from output ports of the amplifier to first and second input signals having a phase relationship for insuring operation of the apparatus as an oscillator. The amplifier is comprised of first, second and third plates, an elongated reed member, first and second torsional members and a tab, all of which are made of a material having negligible coefficient of expansion and negligible change in modulus of elasticity over the operating temperature range. The reed member is positioned within an elongated slot in the first plate, and is fixed to the first plate by the first and second torsional members, wherein the major axis of the torsional members is perpendicular to the plane and major axis of the reed member. The second and third plates each has a supply port, a channel fluidically coupled to the supply port and an output port fluidically coupled to the channel. The tab extends from the reed member in a plane perpendicular to the major axis of the torsional members and the reed member, and has a hole therethrough. The tab is received within the channels in the second and third plates, and is movable between a first and a second position upon corresponding movement of the reed member which is responding to the reception of the first and second fluidic input signals from the fluidic feedback means.

When the first signal moves the reed member and the tab to the first position, the hole in the tab is aligned within the channel in the second plate, thereby allowing supply fluid to flow from the supply port and out of the output port in the second plate. At the same time, the hole is misaligned with the channel in the third plate, thereby blocking the flow of supply fluid to the output port in the third plate. When the second signal moves the reed member and the tab to the second position, the hole in the tab is aligned within the channel in the third plate, thereby allowing supply fluid to flow from the supply port and out of the output port in the third plate. Similarly, at the same time, the hole in the tab is misaligned with the channel in the second plate, thereby preventing supply fluid from flowing from the supply port and out of the output port in the second plate. Under these circumstances, the fluidic resonant frequency of the oscillator is approximately equal to the fixed and predetermined mechanical resonant frequency of the reed member, whereby the oscillator oscillates at the desired mechanical resonant frequency of the reed member.

The fluidic feedback means is comprised of a fluidic flip flop, and first and second fluidic capacitors. The flip flop has a supply port, first and second control ports and first and second output ports, wherein the first and second input signals to the reed member are fluidically coupled thereto from the respective first and second output ports of the flip flop. The first and second fluidic capacitors fluidically couple the fluidic signals from each of the respective output ports of the second and third plates of the torsional reed reference amplifier to the respective first and second control ports of the flip flop, and affect the phase relationship of the fluidic signals which are applied to the reed member.

The fluidic feedback means can be further comprised of a fluidic proportional amplifier having a supply port, first and second control ports and first and second output ports, wherein the first and second control ports of the proportional amplifier are fluidically connected to the respective first and second fluidic capacitors, and the first and second output ports of the proportional amplifier are fluidically connected to the respective first and second control ports of the flip flop. The proportional amplifier provides a sufficient increase in gain in the fluidic feedback loop to insure self starting of the fluidic oscillator at low operating pressures ranging from 1 to 4 psi.

DESCRIPTION OF THE PREFERRED EMBODIMENTS

One embodiment of the invention will now be described with reference to FIGS. 1 and 4.

Figures 1, 2:
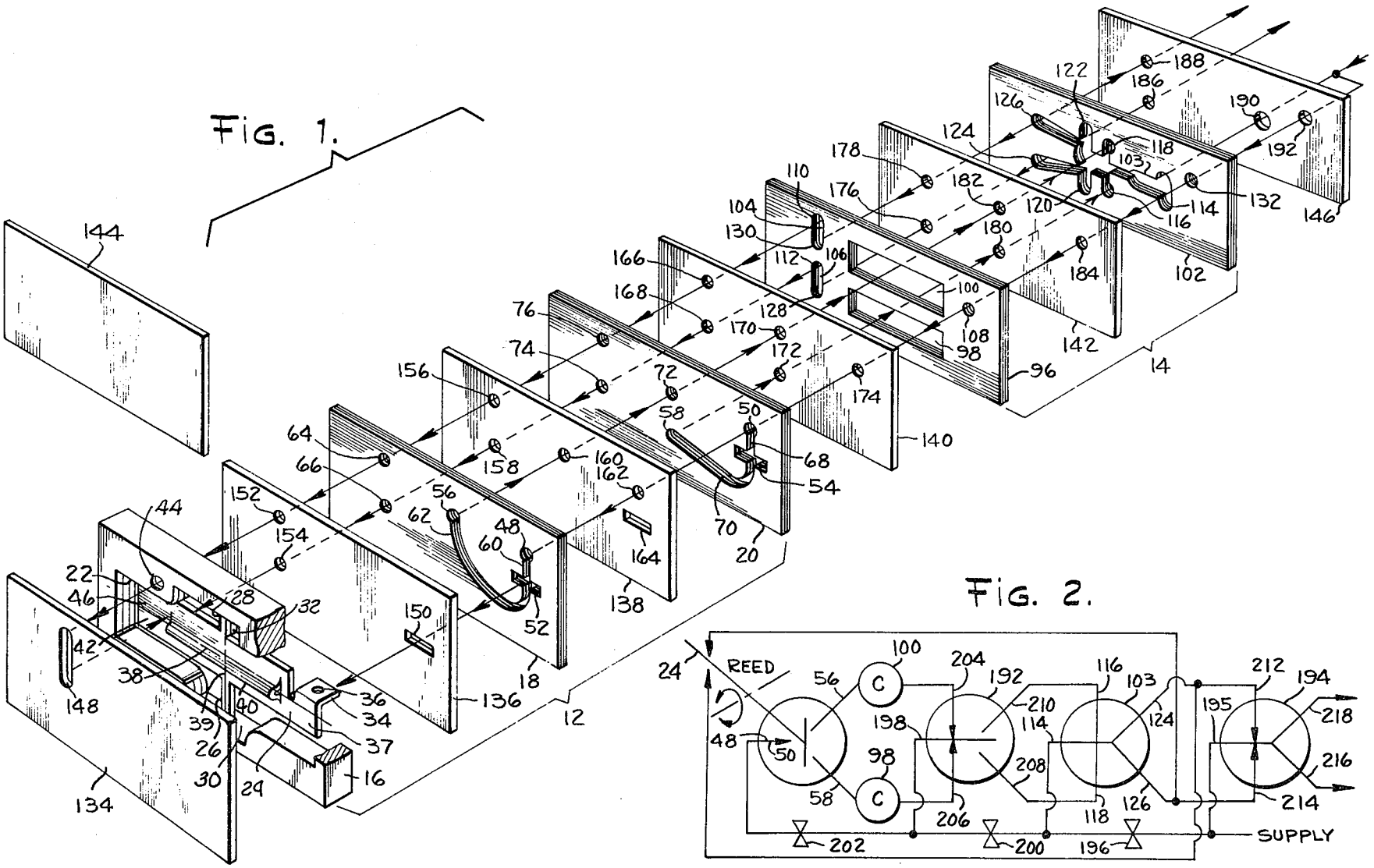
FIG. 1 is an exploded perspective view of the torsional reed reference fluidic oscillator in accordance with this invention.
FIG. 2 is a fluidic circuit diagram of the torsional reed oscillator shown in FIG. 1, further including a proportional amplifier in the feedback loop, and also an output digital amplifier stage.

As shown in FIG. 1, a torsional reed reference fluidic oscillator 10 is comprised of a torsional reed reference amplifier 12 and fluidic feedback means 14 for converting signals from output ports of the amplifier to first and second input signals having a phase relationship that insures operation of the apparatus as an oscillator.

Amplifier 12 is further comprised of respective first, second, and third plates 16, 18, and 20. Plate 16 has an elongated slot 22 extending therethrough, and an elongated reed member 24 is positioned within slot 22 parallel to the major axis of the slot. A pair of torsional members 26 and 28 extend, within respective expanded portions 30 and 32 of the slot, in a direction perpendicular to the major axis of the slot, and are used to mechanically couple reed member 24 to plate 16. A tab 34, having a hole 36 therethrough, extends from one end 37 of reed member 24 in a direction perpendicular to the plane of the reed member, wherein the torsional axis is coincident with a major axis of torsional members 26 and 28. Reed member 24 includes a rib 40 formed thereon. The rib extends over a major portion of one flat surface 42 of reed member 24 so as to impart a significant degree of rigidity to the reed member. Plate 16 further includes a coupling hole 44 therethrough, which is adjacent another end 46 of reed member 24.

Plates 18 and 20 include respective supply ports 48 and 50, channels 52 and 54 and output ports 56 and 58. Plate 18 further includes a first passageway 60 for fluidically coupling supply port 48 to channel 52, a passageway 62 for fluidically coupling channel 52 to output port 56, and coupling holes 64 and 66. Plate 20 further includes a passageway 68 for fluidically coupling supply port 50 to channel 54, a passageway 70 for fluidically coupling channel 54 to output port 58, and coupling holes 72, 74, and 76. Channels 52 and 54 in respective plates 18 and 20 are aligned with one another, and are dimensioned to receive tab 34 therewithin.

Figure 4:
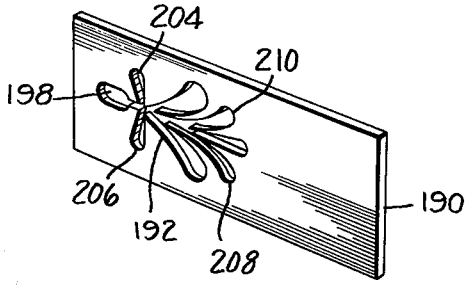
FIG. 4 is a front elevation view of the plate containing the reed member shown in FIG. 1 prior to the formation of the rib on the reed and the bending of the tab perpendicular to the rib.

As shown in FIG. 4, plate 16 can be comprised of a single sheet which is chemically etched or stamped to include stacking holes 78, 80, 82, and 84, elongated slot 22, reed member 24 suspended in slot 22, torsional members 26 and 28, tab 34 having hole 36 therethrough, and a pair of stress relief channels 86 and 88 each extending from respective expanded portions 30 and 32 of slot 22 into respective lower and upper portions 90 and 92 of plate 16 and past respective torsional members 26 and 28. Subsequent to the formation of plate 16 as it is shown in FIG. 4, tab 34 is bent into a plane perpendicular to the plane of reed member 24, and rid 40 is formed along major axis 38 of reed member 24. Stress relief channels 86 and 88 primarily serve to prevent deformation of torsional members 26 and 28 and the shifting of the torsional axis during the formation of rib 40 on reed member 24.

Again referring to FIG. 1, feedback means 14 is comprised of a plate 96, containing capacitor volumes 98 and 100, and a plate 102 containing a fluidic flip-flop 103. Plate 96 further includes a pair of transfer slots 104 and 106 and a coupling hole 108. Coupling hole 108 is aligned and in fluidic communication with supply ports 48 and 50 in respective second and third plates 18 and 20. One end 110 of transfer slot 104 is aligned and in fluidic communication with coupling holes 44, 64 and 76 in respective plates 16, 18 and 20, while one end 112 of transfer slot 106 is aligned and in fluidic communication with coupling holes 66 and 74 in respective plates 18 and 20. Flip-flop 103 in plate 102 includes a supply port 114, control ports 116 and 118, vents 120 and 122, and first and second output receiver ports 124 and 126. Output receiver port 124 is aligned and in fluidic communication with another end 128 of transfer slot 106, while output receiver port 126 is aligned with and fluidically coupled to another end 130 of transfer slot 104. control port 116 is aligned and in fluidic communication with output port 58 in plate 20 via capacitor volume 98, and control port 118 is aligned and in fluidic communication with output port 56 in plate 18 via coupling hole 72 in plate 20 capacitor volume 100 in plate 96. Plate 102 further includes a coupling hole 132, which is aligned and in fluidic communication with supply ports 48 and 50 in respective plates 18 and 20 and coupling hole 108 in plate 96.

In order to insure proper operation of the oscillator, coupling plates 134, 136, 138, 140, 142 and cover plates 144 and 146 are provided. While cover plate 144 is normally aligned with the above referred to plates of the oscillator, it is shown to be out of alignment therewith for the sake of clarity. Coupling plate 134 is positioned adjacent side 42 of reed member 24 and has a transfer slot 148 therein for fluidically coupling hole 44 in plate 16 to end 46 of side 42 of the reed member. Coupling plate 136 is positioned between plates 16 and 18, and includes a transfer channel 150 and respective coupling holes 152 and 154. Coupling hole 152 fluidically couples hole 64 and plate 18 to coupling hole 44 in plate 16, while coupling hole 154 fluidically couples hole 66 in plate 18 to a rear surface (not shown) of end 46 of reed member 24. Coupling plate 138 is positioned between plates 18 and 20, and includes coupling holes 156, 158, 160, and 162 and a transfer channel 164. Transfer channels 150 and 164 are dimensioned to allow tab 34 to pass therethrough and be received in respective channels 52 and 54 of respective plates 18 and 20. Coupling hole 156 fluidically couples hole 76 in plate 20 to hole 64 in plate 18, while couping hole 158 fluidically couples hole 74 in plate 20 to hole 66 in plate 18, and coupling hole 160 fluidically couples output port 56 in plate 18 to hole 72 in plate 20, while coupling hole 162 fluidically couples supply port 50 in plate 20 to supply port 48 in plate 18. Coupling plate 140 is positioned between plates 20 and 96, and includes coupling holes 166, 168, 170, 172, and 174. Coupling hole 166 fluidically couples end 110 of transfer slot 104 in plate 96 to hole 76 in plate 20, and coupling hole 168 fluidically couples end 112 of transfer slot 106 in plate 96 to hole 74 in plate 20. Coupling hole 170 fluidically couples hole 72 in plate 20 to capacitor volume 100, and coupling hole 172 fluidically couples output port 58 in plate 20 to capacitor volume 98 in plate 96. Furthermore, coupling hole 174 fluidically couples hole 108 in plate 96 to supply port 50 in plate 20. Coupling plate 142 is positioned between plates 96 and 102 and includes coupling holes 176, 178, 180, 182, and 184. Coupling holes 176 and 178 fluidically couple respective output receiver ports 124 and 126 in plate 102 to respective ends 128 and 130 of respective transfer slots 106 and 104 in plate 96, while coupling holes 180 and 182 fluidically couple respective capacitor volumes 98 and 100 in plate 96 to respective control ports 116 and 118 of the flip-flop in plate 102, and coupling hole 184 fluidically couples hole 132 in plate 102 to hole 108 in plate 96. Cover plate 146 is aligned with and on the opposite side of plate 102, and includes output ports 186 and 188 and supply ports 190 and 192. Output ports 186 and 188 fluidically couple respective output receiver ports 124 and 126 of the flip-flop in plate 102 to an output fluidic amplifier or other suitable load, while supply ports 190 and 192 fluidically couple a fluidic source of supply (not shown) to respective supply port 114 and coupling hole 132 in plate 102. Cover plate 144 is positioned adjacent the front side (in accordance with FIG. 1) of coupling plate 134, and serves to isolate transfer slot 148 from the atmosphere.

At this point it should be noted that plates 18, 20, 96 and 102 can each be comprised of a plurality of laminated sheets which are either diffusion bonded or bolted together, wherein each sheet can be either chemically etched or stamped to contain the above described elements and configuration. It should also be noted that plates 16, 18, 20, 96 and 102, the coupling and cover plates, reed member 24, tab 34 and torsional members 26 and 28 are comprised of material having negligible thermal coefficient of expansion and negligible change in modulus of elasticity between a temperature range of −65° to +165°F for preventing a change in the operating characteristics of the oscillator over the above temperature range. One such suitable material is a nickel-iron-chromium-titanium alloy known as Ni Span C alloy 902 manufactured by Engelhard Industries, a Division of Engelhard Minerals and Chemicals Corp.

The operation of the oscillator will now be explained. Supply fluid is fed from the supply source to supply ports 48 and 50 in plates 18 and 20 of amplifier 12 via coupling hole 192 in cover plate 146, coupling hole 132 in plate 102, coupling hole 184 in plate 142, coupling hole 108 in plate 96 and coupling hole 174 in plate 140. Similarly, supply fluid flows to supply port 114 of flip flop 103 in plate 102 via coupling hole 190 in cover plate 146. In this instance, we will assume that hole 36 in tab 34 is initially aligned within channel 54 in plate 20 and in misalignment with channel 52 in plate 18. Under these circumstances, the supply fluid flows from supply port 50 to output port 58 in plate 20, and this output signal flows to control port 116 in the flip flop in plate 102 via coupling hole 172 in coupling plate 140, capacitor volume 98 in plate 96, and coupling hole 180 in plate 142. This, in turn, causes a fluidic signal to flow from output receiver port 126 of the flip flop in plate 102 to an output amplifier or other suitable load via coupling hole 188 in cover plate 146. Similarly, this signal serves as the first input signal applied to amplifier 12 as it impinges on the front face (with reference to FIG. 1) of end 46 of reed member 24 after flowing from output receiver port 126 of the flip flop and through hole 178 in plate 142, transfer slot 104 in plate 96, hole 166 in plate 140, hole 76 in plate 20, hole 156 in plate 138, hole 64 in plate 18, hole 152 in plate 136, hole 44 in plate 16 and transfer slot 148 in plate 134. This signal causes a corresponding movement in the reed member about its torsional axis so that hole 36 in tab 34 becomes aligned within channel 52 in plate 18 and misaligned with channel 54 in plate 20. Under these circumstances, supply fluid flows from supply port 48 to output port 56 in plate 18, and a fluidic signal is fluidically coupled to control port 118 in the flip flop in plate 102 via coupling hole 160 in plate 138, coupling hole 72 in plate 20, coupling hole 170 in plate 140, capacitor volume 100 in plate 96, and coupling hole 182 in plate 142. This, in turn, causes a change in the state of the flip flop in plate 102 and a fluidic signal flows out of output receiver 124 in the flip flop to an output amplifier or other suitable load via port 186 in cover plate 146. Similarly, the signal from receiver port 124 provides the second input signal to the torsional amplifier which is fed back to the rear side (not shown) of end 46 of reed member 24 via coupling hole 176 in plate 142, transfer slot 106 in plate 96, coupling hole 168 in plate 140, coupling hole 74 in plate 20, coupling hole 158 in plate 138, coupling hole 66 in plate 18 and coupling hole 154 in plate 136. This, in turn, causes reed member 24 to move in an opposite direction about its torsional axis, and again causes hole 36 in tab 34 to be aligned within channel 54 of plate 20 and misaligned with channel 52 in plate 18. The apparatus continues to operate as described above, and oscillating fluidic signals are thereby produced at output ports 186 and 188 in cover plate 146.

It should be noted that the capacitor volumes in plate 96 serve to adjust the phase shift of the output signals from the torsional amplifier, which are fed back to the amplifier as input signals, in a manner to insure that the natural fluidic resonant frequency of the oscillator is approximately equal to the mechanical resonant frequency of reed member 24 about its torsional axis. This insures that the oscillator will, in fact, oscillate at a fixed mechanical resonant frequency of the reed member, wherein the square of the mechanical resonant frequency ($\omega^2$) is equal to the torsional spring rate of torsional members 26 and 28 divided by the movement of inertia of the reed member about its torsional axis. This mechanical resonant frequency is thus independent of the changes in the fluidic resonant frequency of the oscillator, and thereby remains stable over the desired temperature range of approximately −65° to approximately +165°F.

Figure 3:
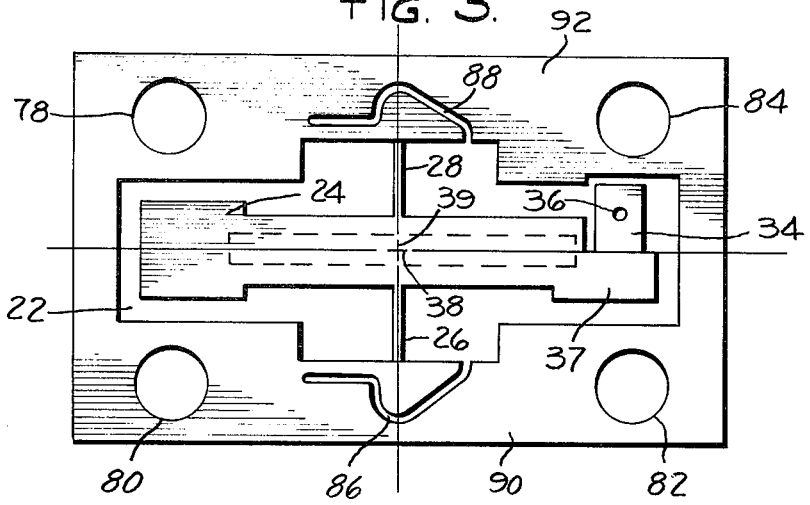
FIG. 3 is a perspective view of a plate containing a proportional amplifier.

In order to insure self starting of the oscillator and satisfactory performance at low operating pressures ranging from 1 to 4 psi, the gain of the feedback means is increased by inserting a plate 190 containing a fluidic proportional amplifier 192, shown in FIG. 3, between plates 96 and 102. This is more clearly understood by referring to the fluidic circuit diagram shown in FIG. 2. This circuit diagram also includes an output digital amplifier 194 which serves as the load for the oscillator. In operation, the fluidic supply signal flows to a supply port 195 of digital amplifier 194, supply port 114 of flip flop 103 via a flow control valve 196, a supply port 198 of proportional amplifier 192 via a flow control valve 200, and supply ports 48 and 50 of torsional amplifier 12 via a flow control valve 202. The output signals from torsional amplifier 12 flow out of respective output ports 56 and 58 to respective control ports 204 and 206 of proportional amplifier 192 via respective capacitor volumes 100 and 98. Output signals from respective output receiver ports 208 and 210 of proportional amplifier 192 then flow to respective control ports 118 and 116 of flip flop 103. As previously stated when describing the operation of the oscillator shown in FIG. 1, fluidic input signals flow back to reed member 24 from respective output receiver ports 124 and 126 of the flip flop, while in this instance, output signals from output receiver ports 124 and 126 also flow to respective control ports 212 and 214 of digital amplifier 194. This, in turn, causes signals to be generated at respective output receiver ports 216 and 218 of the digital amplifier.

Thus, not only is the oscillator, shown in schematic in FIG. 2, self starting at low operating pressures of approximately 1 to 4 psi, it is also capable of operating at 0.1% frequency stability over a temperature range of −65° to +165°F, due, additionally, to the rigidity of the reed member provided by rib 40, and to the positioning of tab 34 in a plane perpendicular to both the torsional axis and major axis of reed member 24.

While torsional reed amplifier 12 has been described as a component of oscillator 10, it is to be understood that amplifier 12 can be independently operated as either a proportional or digital fluidic amplifier component which can respond to fluidic input signals and can drive an output fluidic load.

Although the invention has been described with reference to specific embodiments thereof, numerous modifications are possible without departing from the invention, and it is desirable to cover all modifications falling within the spirit and scope of this invention.

What we claim as new and desire to secure by Letters Patent of the United States is:

1. A torsional reed reference fluidic oscillator operating within 0.1% of the desired frequency over a temperature range of −65° to +165°F and an operating pressure of from about 1 to about 4 psi including:

A a torsional reed fluidic amplifier comprising:

a. a first plate having an elongated slot therethrough;

b. an elongated reed member positioned within said slot and extending in a plane parallel to a plane of said first plate, said reed member including a rib extending parallel to a major axis of a plane of said reed member for imparting rigidity to said reed member;

c. first and second torsional members positioned within said slot and having a major axis perpendicular to the major axis of said reed member for mechanically coupling said reed member to said first plate;

d. second and third plates each having a supply port, a channel fluidically coupled to said supply port, and an output port fluidically coupled to said channel; and e. a tab extending from said reed member in a plane perpendicular to the major axis of said torsional members and said reed member and having a hole therethrough, said tab being received within said channels in said second and third plates and movable between a first and a second position upon corresponding movement of said reed member in response to the receiving of first and second fluidic input signals, said first, second and third plates, said reed member, said tab and said torsional members all being comprised of a material having negligible thermal coefficient of expansion and negligible change in modulus of elasticity over said temperature range, whereby when said first input signal moves said reed member and said tab to said first position, said hole in said tab is aligned within said channel in said second plate, thereby allowing supply fluid to flow from said supply port and out of said output port in said second plate, while said hole is misaligned with said channel in said third plate, thereby blocking the flow of supply fluid to said output port in said third plate, and when said second signal moves said reed member and said tab to said second position, said hole in said tab is aligned within said channel in said third plate, thereby allowing supply fluid to flow from said supply port and out of said output port in said third plate, while said hole in said tab is misaligned with said channel in said second plate, thereby preventing supply fluid from flowing from said supply port and out of said output port in said second plate; and B. fluidic feedback means for converting output signals from said output ports in said second and third plates to said first and second input signals having a phase relationship that establishes a fluidic resonant frequency for said oscillator approximately equal to a fixed mechanical frequency of said reed member, whereby said oscillator oscillates at the fixed mechanical frequency of said reed member.

2. A torsional reed reference fluidic oscillator according to claim 1, wherein said fluidic feedback means is comprised of:

a. a fluidic flip flop having a supply port, first and second control ports and first and second output ports, said first and second input signals being fluidically coupled to said reed member from said respective first and second output ports of said flip flop; and b. first and second fluidic capacitors for fluidically coupling and adjusting the phase of fluidic signals from said respective output ports of said second and third plates to said respective first and second control ports of said flip flop.

3. A torsional reed reference fluidic oscillator according to claim 2, wherein said fluidic feedback means is further comprised of a fluidic proportional amplifier having a supply port, first and second control ports and first and second output ports, said first and second control ports of said proportional amplifier being fluidically connected to said respective first and second fluidic capacitors, and said first and second output ports of said proportional amplifier being fluidically connected to said respective first and second control ports of said flip flop, whereby the gain of said proportional amplifier insures self starting of said fluidic oscillator at operating pressures ranging from about 1 to about 4 psi.

4. A torsional reed reference fluidic oscillator including:

A. a torsional reed fluidic amplifier comprising:

a. a first plate having an elongated slot therethrough;

b. an elongated reed member positioned within said slot and extending in a plane parallel to a plane of said first plate;

c. first and second torsional members positioned within said slot and having a major axis perpendicular to a major axis of said slot and said reed member for mechanically coupling said reed member to said first plate;

d. second and third plates each having a supply port, a channel fluidically coupled to said supply port, and an output port fluidically coupled to said channel; and e. a tab extending from said reed member in a plane perpendicular to the major axis of said torsional members and said reed member and having a hole therethrough, said tab being received within said channels in said second and third plates and movable between a first and a second position upon corresponding movement of said reed member in response to the receiving of first and second fluidic input signals, whereby when said first input signal moves said reed member and said tab to said first position, said hole in said tab is aligned within said channel in said second plate, thereby allowing supply fluid to flow from said supply port and out of said output port in said second plate, while said hole is misaligned with said channel in said third plate, thereby blocking the flow of supply fluid to said output port in said third plate, and when said second input signal moves said reed member and said tab to said second position, said hole in said tab is aligned within said channel in said third plate, thereby allowing supply fluid to flow from said supply port and out of said output port in said third plate, while said hole in said tab is misaligned with said channel in said second plate, thereby preventing supply fluid from flowing from said supply port and out of said output port in said second plate; and B. fluidic feedback means for converting output signals from said output ports in said second and third plates to said first and second input signals having a phase relationship that establishes a fluidic resonant frequency for said oscillator approximately equal to a fixed mechanical frequency of said reed member, whereby said oscillator oscillates at the fixed mechanical frequency of said reed member.

5. A torsional reed reference fluidic oscillator according to claim 4, wherein said supply ports in said second and third plates are in alignment with each other.

6. A torsional reed reference fluidic oscillator according to claim 4, wherein said channels in said second and third plates are in alignment with each other.

7. A torsional reed reference fluidic oscillator according to claim 4, wherein said reed member includes a rigid rib extending along the major axis of said reed member for imparting rigidity to said reed member.

8. A torsional reed reference fluidic oscillator according to claim 7, wherein said first plate has first and second stress relief channels therein, said first stress relief channel extending from said slot into said first plate and past the major axis of said first torsional member, and said second stress relief channel extending from said slot into said first plate and past the major axis of said second torsional member, whereby said stress relief channels prevent distortion of said first and second torsional members during the formation of said rib of said reed member.

9. A torsional reed reference fluidic oscillator according to claim 4, wherein said first, second and third plates, said reed member, said tab and said first and second torsional members are comprised of a material having negligible thermal coefficient of expansion and negligible change in modulus of elasticity between a temperature range of −65° to +165°F for preventing a change in the operating characteristics of said oscillator over said temperature range.

10. A torsional reed reference fluidic oscillator according to claim 4, wherein said fluidic feedback means is comprised of:

a. a fluidic flip flop having a supply port, first and second control ports and first and second output ports, said first and second input signals being fluidically coupled to said reed member from said respective first and second output ports of said flip flop; and b. first and second fluidic capacitors for fluidically coupling and adjusting the phase of fluidic signals from said respective output ports of said second and third plates to said respective first and second control ports of said flip flop.

11. A torsional reed reference fluidic oscillator according to claim 10, wherein said fluidic feedback means is further comprised of a fluidic proportional amplifier having a supply port, first and second control ports and first and second output ports, said first and second control ports of said proportional amplifier being fluidically connected to said respective first and second fluidic capacitors, and said first and second output ports of said proportional amplifier being fluidically connected to said respective first and second control ports of said flip flop, whereby the gain of said proportional amplifier insures self starting of said fluidic oscillator at operating pressures ranging from about 1 to about 4 psi.

12. A torsional reed reference fluidic oscillator including:

A. a torsional reed fluidic amplifier comprising:

a. a first plate having an elongated slot therethrough;

b. an elongated reed member positioned within said slot and extending in a plane parallel to a plane of said first plate, said reed member including a rib extending parallel to a major axis of the plane of said reed member for imparting rigidity to said reed member;

c. first and second torsional members positioned within said slot and having a major axis perpendicular to the major axis of said reed member for mechanically coupling said reed member to said first plate;

d. second and third plates each having a supply port, a channel fluidically coupled to said supply port, and an output port fluidically coupled to said channel; and e. a tab extending from said reed member in a plane perpendicular to the major axis of said reed member and having a hole therethrough, said tab being received within said channels in said second and third plates and movable between a first and a second position upon corresponding movement of said reed member in response to the receiving of first and second fluidic input signals, whereby when said first input signal moves said reed member and said tab to said first position, said hole in said tab is aligned within said channel in said second plate, thereby allowing supply fluid to flow from said supply port and out of said output port in said second plate, while said hole is misaligned with said channel in said third plate, thereby blocking the flow of supply fluid to said output port in said third plate, and when said second input signal moves said reed member and said tab to said second position, said hole in said tab is aligned within said channel in said third plate, thereby allowing supply fluid to flow from said supply port and out of said output port in said third plate, while said hole in said tab is misaligned with said channel in said second plate, thereby preventing supply fluid from flowing from said supply port and out of said output port in said second plate; and B. fluidic feedback means for converting output signals from said output ports in said second and third plates to said first and second input signals having a phase relationship that establishes a fluidic resonant frequency for said oscillator approximately equal to a fixed mechanical frequency of said reed member, whereby said oscillator oscillates at the fixed mechanical frequency of said reed member.

13. A torsional reed reference fluidic oscillator according to claim 12, wherein said supply ports in said second and third plates are in alignment with each other.

14. A torsional reed reference fluidic oscillator according to claim 12, wherein said channels in said second and third plates are in alignment with each other.

15. A torsional reed reference fluidic oscillator according to claim 12, wherein said tab extends from said reed member in a plane perpendicular to the major axis of said torsional members.

16. A torsional reed reference fluidic oscillator according to claim 12, wherein said first, second and third plates, said reed member, said tab and said first and second torsional members are comprised of a material having negligible thermal coefficient of expansion and negligible change in modulus of elasticity between a temperature range of −65° to +165°F for preventing a change in the operating characteristics of said oscillator over said temperature range.

17. A torsional reed reference fluidic oscillator according to claim 12, wherein said first plate has first and second stress relief channels formed therein, said first stress relief channel extending from said slot into said first plate and past the major axis of said first torsional member, and said second stress relief channel extending from said slot into said first plate and past the major axis of said second torsional member, whereby said stress relief channels prevent distortion of said first and second torsional members during the formation of said rib of said reed member.

18. A torsional reed reference fluidic oscillator according to claim 12, wherein said fluidic feedback means is comprised of:

a. a fluidic flip flop having a supply port, first and second control ports and first and second output ports, said first and second input signals being fluidically coupled to said reed member from said respective first and second output ports of said flip flop; and b. first and second fluidic capacitors for fluidically coupling and adjusting the phase of fluidic signals from said respective output ports of said second and third plates to said respective first and second control ports of said flip flop.

19. A torsional reed reference fluidic oscillator according to claim 18, wherein said fluidic feedback means is further comprised of a fluidic proportional amplifier having a supply port, first and second control ports and first and second output ports, said first and second control ports of said proportional amplifier being fluidically connected to said respective first and second fluidic capacitors, and said first and second output ports of said proportional amplifier being fluidically connected to said respective first and second control ports of said flip flop, whereby the gain of said proportional amplifier insures self starting of said fluidic oscillator at operating pressures ranging from about 1 to about 4 psi.

20. A torsional reed fluidic amplifier comprising:

a. a first plate having an elongated slot therethrough;

b. an elongated reed member positioned within said slot and extending in a plane parallel to a plane of said first plate;

c. first and second torsional members positioned within said slot and having a major axis extending perpendicular to a major axis of said slot and said reed member for mechanically coupling said reed member to said first plate;

d. second and third plates each having a supply port, a channel fluidically coupled to said supply port, and an output port fluidically coupled to said channel; and e. a tab extending from said reed member in a plane perpendicular to the major axis of said torsional members and said reed member and having a hole therethrough, said tab being received within said channels in said second and third plates and movable between a first and a second position upon corresponding movement of said reed member in response to the receiving of first and second fluidic signals, whereby when said first input signal moves said reed member and said tab to said first position, said hole in said tab is aligned within said channel in said second plate, thereby allowing supply fluid to flow from said supply port and out of said output port in said second plate, while said hole is misaligned with said channel in said third plate, thereby blocking the flow of supply fluid to said output port in said third plate, and when said second input signal moves said reed member and said tab to said second position, said hole in said tab is aligned within said channel in said third plate, thereby allowing supply fluid to flow from said supply port and out of said output port in said third plate, while said hole in said tab is misaligned with said channel in said second plate, thereby preventing supply fluid from flowing from said supply port and out of said output port in said second plate.

21. A torsional reed fluidic amplifier according to claim 20, wherein said supply ports in said second and third plates are in alignment with each other.

22. A torsional reed fluidic amplifier according to claim 20, wherein said channels in said second and third plates are in alignment with each other.

23. A torsional reed fluidic amplifier according to claim 20, wherein said reed member includes a rigid rib extending along the major axis of said reed member for imparting rigidity to said reed member.

24. A torsional reed fluidic amplifier according to claim 23, wherein said first plate has first and second stress relief channels therein, said first stress relief channel extending from said slot into said first plate and past the major axis of said first torsional member, and said second stress relief channel extending from said slot into said first plate and past the major axis of said second torsional member, whereby said stress relief channels prevent distortion of said first and second torsional members during the formation of said rib of said reed member.

25. A torsional reed fluidic amplifier according to claim 20, wherein said first, second and third plates, said reed member, said tab and said first and second torsional members are comprised of a material having negligible thermal coefficient of expansion and negligible change in modulus of elasticity between a temperature range of −65°F to +165°F for preventing a change in the operating characteristics of said amplifier over said temperature range.

26. A torsional reed fluidic amplifier comprising:

a. a first plate having an elongated slot therethrough;

b. an alongated reed member positioned within said slot and extending in a plane parallel to a plane of said first plate, said reed member including a rib extending parallel to a major axis of a plane of said reed member for imparting rigidity to said reed member;

c. first and second torsional members positioned within said slot and having a major axis extending perpendicular to the major axis of said reed member for mechanically coupling said reed member to said first plate;

d. second and third plates each having a supply port, a channel fluidically coupled to said supply port, and an output port fluidically coupled to said channel; and e. a tab extending from said reed member in a plane perpendicular to the major axis of said reed member and having a hole therethrough, said tab being received within said channels in said second and third plates and movable between a first and a second position upon corresponding movement of said reed member in response to the receiving of first and second fluidic input signals, whereby when said first input signal moves said reed member and said tab to said first position, said hole in said tab is aligned within said channel in said second plate, thereby allowing supply fluid to flow from said supply port and out of said output port in said second plate, while said hole is misaligned with said channel in said third plate, thereby blocking the flow of supply fluid to said output port in said third plate, and when said second input signal moves said reed member and said tab to said second position, said hole in said tab is aligned within said channel in said third plate, thereby allowing supply fluid to flow from said supply port and out of said output port in said third plate, while said hole in said tab is misaligned with said channel in said second plate, thereby preventing supply fluid from flowing from said supply port and out of said output port in said second plate.

27. A torsional reed fluidic amplifier according to claim 26, wherein said supply ports in said second and third plates are in alignment with each other.

28. A torsional reed fluidic amplifier according to claim 26, wherein said channels in said second and third plates are in alignment with each other.

29. A torsional reed fluidic amplifier according to claim 26, wherein said tab extends from said reed member in a plane perpendicular to the major axis of said torsional members.

30. A torsional reed fluidic amplifier according to claim 26, wherein said first, second and third plates, said reed member, said tab and said first and second torsional members are comprised of a material having negligible thermal coefficient of expansion and negligible change in modulus of elasticity between a temperature range of −65°F to +165°F for preventing a change in the operating characteristics of said amplifier over said temperature range.

31. A torsional reed fluidic amplifier according to claim 26, wherein said first plate has first and second stress relief channels formed therein, said first stress relief channel extending from said slot into said first plate and past the major axis of said first torsional member, and said second stress relief channel extending from said slot into said first plate and past the major axis of said second torsional member, whereby said stress relief channels prevent distortion of said first and second torsional members during the formation of said rib of said reed member.

* * * * *

PO-1050
(5/69)

UNITED STATES PATENT OFFICE
CERTIFICATE OF CORRECTION

Patent No. 3,942,558 Dated March 9, 1976

Inventor(s) Honda, Thomas S. and Ringwall, Carl G.

It is certified that error appears in the above-identified patent and that said Letters Patent are hereby corrected as shown below:

Column 8, line 12, after "-65°", insert -- F --

Column 8, line 55, after "second", insert -- input --

Column 10, line 46, after "-65°", insert -- F --

Column 12, line 14, after "-65°", insert -- F --

Column 13, line 11, before "signals", insert -- input --

Column 13, line 61, delete "alongated", and insert -- elongated --

Signed and Sealed this
Tenth Day of August 1976

[SEAL]

*Attest:*

RUTH C. MASON
*Attesting Officer*

C. MARSHALL DANN
*Commissioner of Patents and Trademarks*